US006138753A

United States Patent [19]

Mohaupt

[11] Patent Number: 6,138,753

[45] Date of Patent: Oct. 31, 2000

[54] TECHNIQUE FOR TREATING HYDROCARBON WELLS

[75] Inventor: Henry H. Mohaupt, Santa Barbara, Calif.

[73] Assignee: Mohaupt Family Trust

[21] Appl. No.: 09/182,317

[22] Filed: Oct. 30, 1998

[51] Int. Cl.[7] ..... E21B 37/00; E21B 43/263; E21B 47/10; E21B 49/00

[52] U.S. Cl. ..... 166/250.02; 166/63; 166/250.01; 166/288; 166/299; 166/312

[58] Field of Search ..... 166/63, 250.01, 166/250.02, 252.5, 288, 299, 305.1, 307, 311, 312, 381; 73/152.39, 152.41, 152.55

[56] References Cited

U.S. PATENT DOCUMENTS

| | | | |
|---|---|---|---|
| 2,740,478 | 4/1956 | Greene . | |
| 3,029,732 | 4/1962 | Greene . | |
| 3,830,299 | 8/1974 | Thomeer | 166/281 |
| 4,064,935 | 12/1977 | Mohaupt | 166/63 |
| 4,081,031 | 3/1978 | Mohaupt | 166/299 |
| 4,160,482 | 7/1979 | Erbstoesser et al. | 166/307 X |
| 4,643,254 | 2/1987 | Barbosa et al. | 166/292 |
| 4,787,456 | 11/1988 | Jennings, Jr. et al. | 166/299 X |
| 4,936,385 | 6/1990 | Weaver | 166/288 |
| 4,976,318 | 12/1990 | Mohaupt | 166/311 |
| 5,005,641 | 4/1991 | Mohaupt | 166/63 |
| 5,101,900 | 4/1992 | Dees | 166/288 X |
| 5,145,013 | 9/1992 | Dees | 166/295 |
| 5,178,218 | 1/1993 | Dees | 166/299 X |
| 5,211,224 | 5/1993 | Bouldin | 166/63 |
| 5,443,123 | 8/1995 | Wall | 166/288 |
| 5,551,344 | 9/1996 | Couet et al. | 166/297 X |
| 5,775,426 | 7/1998 | Snider et al. | 166/297 X |

*Primary Examiner*—George Suchfield
*Attorney, Agent, or Firm*—G. Turner Moller

[57] ABSTRACT

A hydrocarbon producing well is treated by first igniting a gas generating charge in the well to clean out perforations communicating between the casing and the formation without creating high permeability channels adjacent the perforations or fracturing the formation in a macroscopic sense. Then, a treatment liquid is injected into the wells by a gas generating propellant charge placed in the production string and then ignited. The propellant charge is designed to produce a minimum horsepower sufficient to push the liquid more-or-less equally through all of the open perforations. The propellant charge is designed to produce a maximum horsepower which is less than what is necessary to fracture the formation. Basically, the combustion rate of the propellant charge is reduced by one of a multiplicity of techniques to produce a long, relatively slow combustion rate.

21 Claims, 2 Drawing Sheets

44
16
22
24
42
10
38
14
40
26
30
20
32
12
36
18
20
34
28

TECHNIQUE FOR TREATING HYDROCARBON WELLS

This invention relates to a technique for treating hydrocarbon wells by igniting a gas propellant charge in the well.

BACKGROUND OF THE INVENTION

There are a number of situations where hydrocarbon wells are treated by igniting a gas generator in the well and allowing the high pressure combustion products to flow into a subterranean formation intersecting the well. One such treatment is a fracturing treatment, roughly analogous to hydraulic fracturing, where the purpose is to increase the permeability of the formation adjacent the perforations. Rather than fracturing the formation and then propping it open with sand, as in hydraulic fracturing, the mechanism is that the high pressure combustion gases initiate and then erode micro and radial fractures originating from each perforation channel.

Oil and gas wells are subject to many ailments, some of which are treatable by injecting a treatment liquid into the formation. As used herein, a liquid is a material which is at a temperature above its melting point and below its boiling point and includes slurries. Examples are the injection of resins to reduce sand movement into the production string and the injection of solvents to remove asphaltenes accumulating in the zone near the well bore.

Most treatment liquids are injected into hydrocarbon bearing formations with a pump truck by a process known as bullheading, i.e. a truck drives up to the well and pumps the treatment liquid down the production string into the formation. The treatment liquid automatically follows the path of least resistance and enters the zones with the highest permeability. The treatment liquid is usually followed with a chaser liquid that displaces the treatment liquid from the production string so all of the treatment liquid is delivered into the formation. This is a time honored practice that has the advantages of simplicity, low costs, and predictable results provided the zones are very thin and homogenous.

There are some situations where more sophisticated and more expensive means of injecting treatment liquids have been proposed and used. One type of approach is to place the treatment liquid in the well and ignite a gas generating propellant in the production string, as shown in U.S. Pat. Nos. 2,740,478; 4,936,385; 5,101,900; 5,145,013 and 5,443,123. Of more general interest is the disclosure in U.S. Pat. No. 3,029,732.

It is known in the prior art to ignite a gas generating charge and create relatively low pressure gaseous combustion products for the purpose of stimulating a well by cleaning out the perforations in production casing or cleaning out the slots in a slotted liner. Examples are found in U.S. Pat. Nos. 4,064,935 and 4,081,031.

SUMMARY OF THE INVENTION

It has been realized that the conventional truck pumping or bullheading techniques for delivering treatment liquids into a subterranean formation overlooks many important factors. Many well treatments performed by bullheading lead to severe damage where permeability contrast between perforations or between areas of the productive formation are high. This contrast in permeability may have occurred because of post completion damage such as the migration of asphaltenes or fines which plug up parts of the formation adjacent the well bore, deposition of scale or the like in the formation adjacent the well bore and other similar processes.

Of course, permeabilities may also vary widely because of naturally occurring permeability contrast in the formation. In any event, a large variation in permeability across a productive interval often leads to ineffective treatments because the treatment liquid is disproportionately delivered to the high permeability areas and little or none is delivered to the low permeability areas. Simply pumping into a formation does nothing to alleviate this problem because the only perforations that are broken down are the most permeable to begin with. Little is done by conventional means to condition low permeability perforations to accept pumped liquids.

This invention is a technique for treating subterranean formations by first igniting a gas generator in a well in such a manner than all of the perforations that communicate with the formation are opened. This technique allows long perforated intervals to be treated with a liquid without mechanically isolating parts of the zone because the large permeability contrasts have been eliminated or substantially minimized so all of the perforations are open and capable of accepting and transmitting the liquid.

This is followed by injecting a treatment liquid into the formation, often by igniting a second gas generator. Use of a gas generator to push the treatment liquid into the formation allows a long perforated interval to be treated. In addition, the perforated interval need not be continuous, i.e. separate productive zones in close proximity may be treated simultaneously by igniting a long, typically tubing conveyed, gas generator.

Thus, a first gas generating charge is ignited in a well containing a formation compatible liquid under circumstances that clean out the perforations, remove impediments to flow through the perforations and present a clean formation face but does not substantially fracture or erode long high permeability channels in the formation. The pressure buildup inside the casing during combustion of a gas generator of this invention creates a sufficient pressure drop across the perforations that flow through the perforations is sub-critical. Critical flow is that flow rate where an additional increase in pressure will not increase fluid flow through the perforations. In this invention, flow is sub-critical, i.e. below critical, because critical flow almost always implies pressures and volumes that fracture the formation or erode long channels away from the perforations. Sub-critical flow in accordance with this invention acts to insure that all of the perforations are open and capable of transmitting a treatment liquid. A treatment liquid is then injected into the subterranean formation under circumstances that does not substantially fracture or erode high permeability channels in the formation so the treatment liquid is more-or-less evenly delivered through all of the open perforations. There are some situations where the first and second treatments are conducted sequentially, with normally less than one day between them. In some situations, the clean out phase is deemed unnecessary and only the liquid treatment is done.

The treatment liquid is placed in the production string of a well to be treated and a gas generating propellant is ignited to produce a large quantity of high pressure combustion gases within the treatment liquid. Such a well is typically a hydrocarbon producing well but may be an injection well, as will be apparent to those skilled in the art. A gas generating propellant charge is placed in the production string and ignited. A substantial quantity of hot, high pressure combustion gases increases the pressure in the well bore and pushes the treatment liquid into the formation.

An important feature of the invention is that the second propellant charge, i.e. the propellant charge used for the treatment phase, is designed so it does not fracture the formation. That has the important advantage that the treatment liquid is forced more evenly through all of the open perforations as contrasted to the situation where one or more high permeability channels have been created or are in the process of being created and the treatment liquid is delivered mainly or preferentially through the perforations communicating with these channels.

The propellant charge for the clean out or conformance treatment is sized to produce sufficient horsepower to clean out the perforations and produce a multiple near wellbore fracture system but not enough horsepower and gas volume to create long, high conductivity fractures or channels in the subterranean formation. The propellant charge for pushing the treatment liquid into the formation is designed to insure that treatment liquid is injected into all of the perforations, not just those having the most permeability. This causes sub-critical flow in the perforations. The delivered horsepower and gas volume of the gas generator is less than what would fracture or erode high permeability channels in the formation. In this aspect of the invention, a relatively longer, slower combustion of a propellant charge larger than a predetermined minimum causes the treatment liquid to be pushed into the formation through all of the perforations without fracturing the formation and thereby causing disproportionate delivery of the treatment liquid through the perforations leading to the fracture. An important part of this invention is conducting a series of well treating applications where these criteria are met.

There are a variety of techniques, some of which are known or discussed in the prior art, of slowing down the rate of combustion of gas generating propellant charges. The propellant material may be selected to burn slower, or may contain a non-combustive diluent. The propellant charge may be made longer and more slender than the geometry of the production string dictates thereby increasing the length of time to combust the charge. The gas generator may includes segments with lower combustion rates, causing an overall lengthening of combustion time. While these techniques may be used alone or in different combinations to produce changes in the burning rate of the gas generators, the adjustments are somewhat difficult and crude and must rely on trial and error. For more predictable results, another method of combustion control has also been used in connection with this invention. It is based on limiting any adjustments of the rate to one component only—the linear ignition velocity of the autonomous axial ignition system—while keeping the radial burn rate of the main propellant constant for all but the most unusual well conditions.

It is an object of this invention to provide an technique of treating a well by first igniting a gas generator to clean out and thereby insure permeability of all perforations and perforation tunnels communicating with a subterranean formation and then igniting a second gas generator to force a treatment liquid through the cleaned out perforations.

Another object of this invention is to treat a well with a liquid by igniting a gas generator in the well under circumstances which force the liquid through perforations into the formation without creating high permeability channels in the formation that may compromise the effectiveness of the treatment.

A further object of this invention is to conduct a series of well treatment applications in which a well treatment liquid is injected into a subterranean formation without fracturing the formation.

Another object of this invention is to treat hydrocarbon bearing formations where sections of the formation exhibit substantially different permeabilities.

Other objects and advantages of this invention will become more fully apparent as this invention proceeds, reference being made to the accompanying drawings and appended claims.

DETAILED DESCRIPTION

Figure 1:
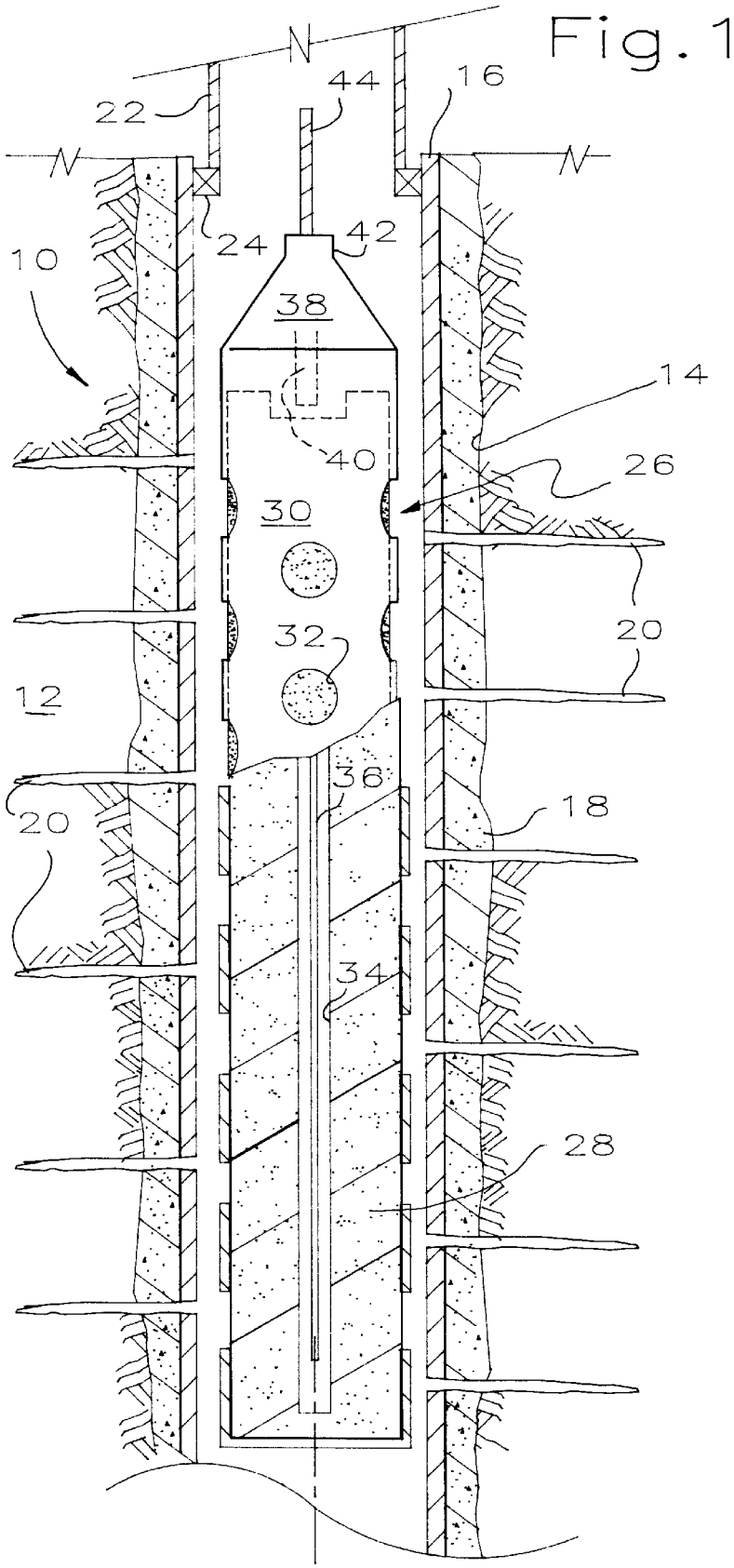
FIG. 1 is a schematic view of a well about to be treated with a gas generator of this invention.

Referring to FIG. 1, there is illustrated a hydrocarbon producing well 10 extending downwardly into the earth to penetrate a subterranean hydrocarbon bearing formation 12. The well includes a bore hole 14, a casing string 16 and a cement sheath 18 isolating the casing string 16 from the bore hole 14. A series of perforations 20 communicate between the formation 12 and the interior of the casing string 16. A tubing or production string 22 extends downwardly into the casing string 16 and a packer 24 seals between the production string 22 and the casing string 16. Although the well 10 is of a conventional type, those skilled in the art will realize that this invention is equally usable on so called tubingless completions where the casing string also acts as the production string.

The subterranean formation 12 is almost always a sedimentary formation because hydrocarbons are not normally found in igneous or metamorphosed rocks. Most hydrocarbon productive formations are either clastics, i.e. sandstones, conglomerates and the like, or carbonates, i.e. limestones, dolomites and the like.

In a typical situation, the well 10 has been on production for some length of time and has developed a production problem that requires treatment. Usually, any liquid treatment is first attempted by bullheading. If bullheading has been attempted and failed, a conformance treatment in accordance with this invention is designed.

In the conformance treatment, a liquid compatible with the formation 12 is placed in the well, usually by simply pumping the desired quantity into the top of the tubing string 22. The liquid can be field salt water, sea water, a hydrocarbon liquid produced from the formation, a solution of potassium chloride and water or the like. This liquid has several functions: to provide a tamp and a coupling for the gas generator 26 and the formation 12 and to clean out the perforations 20 and insure a clean formation face as the liquid is pushed into the formation 12 in response to the combustion of the gas generator 26. Typically, sufficient liquid is put in the hole to extend upwardly 500–1000' above the formation 12 to insure temporary containment of the gaseous combustion products.

The gas generator 26 is lowered into the well, usually on a wire line 44 to a location intermediate the perforations 20. Preferably, the gas generator 28 is designed to be the same length as the perforated interval and the generator 28 is positioned having its lower end at the lowermost perforation and its upper end even with the uppermost perforation. If diameter restrictions in the tubing prevent the desired quantity of propellant in a length corresponding to the length of the perforations, a smaller diameter gas generator of a length greater than the treatment interval is used to provide the desired quantity of propellant.

The gas generator 26 comprises a propellant charge 28 housed in a metal cylindrical carrier 30 having many openings 32 allowing the combustion products to escape from the generator 26. The propellant charge 28 includes a central passage 34 having an autonomous ignition train 36 therein. The ignition train 36 is autonomous meaning that it and its combustion rate is independent of the main propellant charge 28. The gas generator 26 includes a tapered upper end 38 housing an igniter 40 and providing a rope socket 42 for receiving a wire line 44.

The gas generator 26 is designed to produce sufficient horsepower to breakdown and clean out all of the perforations 20 and create microfractures and small radial fractures originating from all of the perforations 20 but not generating long high conductivity fractures or channels extending from the perforations 20 into the formation 12. The gas generator 26 produces less horsepower and gas volume than an optimized conventional fracturing operation conducted by the use of gas generators and produces sub-critical flow in the perforations. Table 1 shows several flow rates through a ⅜" diameter orifice, comparable to a ⅜" diameter perforation:

TABLE 1

Pressure Drop Across an Orifice

| Flow rate | | Pressure | |
|---|---|---|---|
| gal/min | liters/sec | drop, psi | description of flow |
| 25 | 1.57 | 47 | choke flow |
| 50 | 3.15 | 189 | choke flow |
| 100 | 6.3 | 754 | choke flow |
| 200 | 12.61 | 3000 | sub-critical flow |
| 400 | 25.23 | 12000 | sub-critical flow |
| 800 | 50.46 | 48000 | critical flow. |

The reduction in horsepower is accomplished mainly by reducing the rate of combustion of the propellant charge using one or a combination of techniques, such as selecting a propellant that has a lower combustion rate, mixing an inert ingredient into the propellant, making the propellant longer and thinner rather than shorter and fatter, using a gas generator that has slow-burning segments and the like, or preferably by adjusting only one critical component—the axial ignition system burn velocity.

To this end, the horsepower of the gas generator and the total energy output is designed and controlled to produce an amount of work per unit time that is correlated with the type of subterranean formation and its inherent strength, the length of the perforated interval, the existing bottom hole pressure, formation reservoir pressure, fracture gradient, perforation diameter, perforation phasing, number of shots per foot, total number of perforations, viscosity and density of the liquid in the wellbore, well geometry and all completion components, packers and bridge plugs.

Figure 2:
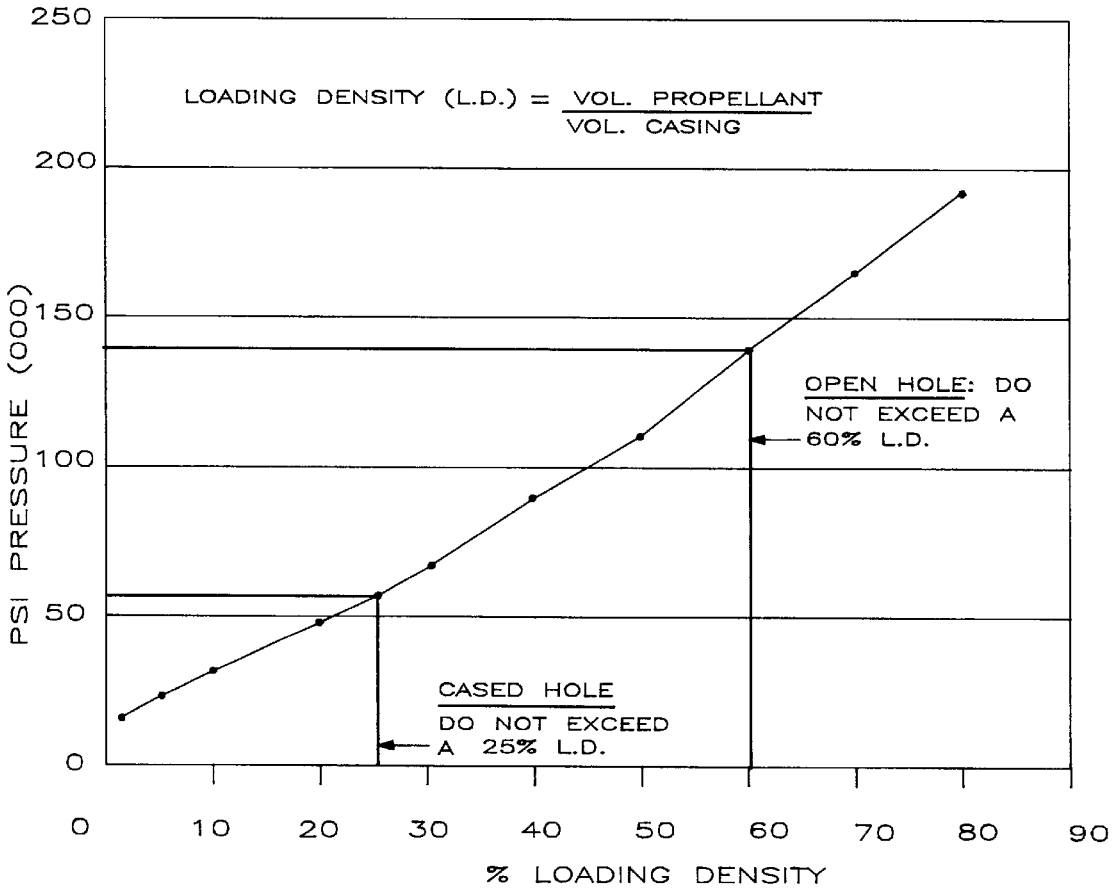
FIG. 2 is a chart showing acceptable loading densities of gas generators in accordance with this invention.

One convenient technique for controlling the horsepower and pressure delivered by the gas generator 26 used in connection with this invention is known as loading density which is the ratio of the cross-sectional area of the gas generator to the cross-sectional are of the inside of the casing in which the generator is ignited. FIG. 2 shows the relationship between pressure and loading density and, in particular, the operating ranges in cased and open holes. Specifically, one should not exceed 25% loading density in a cased hole and 60% loading density in open hole. The pressure calculations are based on propellant gas generator ignition in a closed chamber with no perforations in the casing and zero formation permeability. The pressure recorded in actual field applications are 10–20% of closed chamber projections.

As mentioned previously, a preferred technique for limiting the horsepower, in conjunction with loading density, is to control the linear ignition velocity, the effects of which are shown in Table 2.

TABLE 2

EFFECTS OF VARIOUS IGNITION SYSTEMS ON THE GAS GENERATION RATE AND DELIVERED HORSEPOWER
Gas Generator 2" in Diameter and 12' Long
4½" Casing at 10,000 TVD Under a Full Hydrostatic Load
(Standard perforation density of 4 SPF, diameter of ⅜")

| Ignition Method | Linear Ign. Velocity (Ft/Sec) | Total Burn Time (Sec) | Gas Vol. @ 8000 psi & 372 F (Liters) | Gas Generation Rate (Liters/Sec) | Horsepower |
|---|---|---|---|---|---|
| General preferred range for this invention*: | | | | | |
| Flame Front (Low regime) | 500 | 0.043 | 23.80 | 553 | 1,183,932 |
| Flame Front | 2,000 | 0.025 | 23.80 | 952 | 2,039,960 |
| Detonating Cord (Low velocity) | 20,000 | 0.001 | 23.80 | 23,800 | 50,999,000 |
| Detonating Cord | 26,000 | 0.000536 | 23.80 | 44,403 | 95,147,388 |

*By adjusting the loading density of the gas generator, this range is also applicable to standard gas generator fracturing operations.

The low regime flame front ignition technique is within the scope of this invention because the produced horsepower and gas volume are low enough not to create long channels extending away from the perforation tunnels. Typically, this invention is characterized by linear ignition velocities between 100–2000 feet per second because, generally, the horsepower produced will be sufficiently low not to fracture the formation. Both the Flame Front ignition method and the Low Regime Flame Front ignition method are within the scope of this invention because the produced horsepower and gas volume are low enough not to create long channels extending away from the perforation tunnels. A sufficiently low loading density must also be maintained for both of these ignition methods to meet the requirements of this invention.

After the conformance treatment is conducted, a treatment liquid is injected into the formation 12. Although this may be done by conventional bullheading techniques, it is much preferred to inject the treatment liquid by use of a second gas generator 26 which is typically quite similar in appearance and normally produces the same horsepower as the gas generator used in the conformance treatment. The second gas generator normally delivers essentially the same horsepower because the requirements of the two gas generators are essentially the same, i.e. provide sufficient pressure and energy to push a formation compatible liquid through the perforations 20 into the formation 12 without creating major fractures or eroded channels in the formation 12 adjacent the perforations 20.

As will be more fully apparent from the following examples, an important feature of this invention is its application to formations, particularly hydrocarbon bearing formations, which have high permeability contrasts. The contrast in permeability between perforations in a perforated interval, or in perforations in intervals in close proximity, can be measured by a variety of techniques, such as spinner surveys or injectivity tests. In this invention, high permeability contrasts means that tests show that the conductivity of perforations, defined by the injection pressure at a constant flow rate, varies by at least a factor of 1.5. Another sure indicator of high permeability contrast is when conventional treatments, i.e. bullheading into a formation with a treatment liquid, fail to achieve a desired injection profile. This is substantially different than simply comparing reported permeabilities from side wall cores. Side wall core samples almost always show a difference of permeability that varies substantially. The truth of the matter is that side wall core sample permeability is, in mature areas like the Texas and Louisiana Gulf Coast, not measured at all. Instead, the porosity is measured and an empirical conversion is made from porosity to permeability. It will also be remembered that side wall core samples are typically less than 1" in diameter and about 1" long, i.e. the sample is very small. In addition, core samples are taken in the open hole. Cement invasion into a sandstone when cementing pipe in the well produces much larger permeability contrast. For these and other reasons, variations in core sample permeability do not mean much in the context of this invention. What is important is a large permeability contrast as may be deduced from spinner tests, injectivity tests, failure of simple bullheading and the like.

Another situation where the low controlled horsepower gas generators of this invention are applicable is in the reduction of unwanted water or gas which is being produced along with oil. These types of treatments are more successful when the formation is properly conditioned to receive a chemical gelant and when an appropriate injection technique is used. A procedure for a water control intervention for a formation exhibiting matrix porosity varies, in degree only, from a situation where a specific fracture is targeted for a water shut off treatment.

For treatment of formations with matrix porosity, gas generators are used at two phases of the treatment. The first gas generator should generate a limited micro and radial fracture network adjacent the perforations to facilitate uniform absorption of the gelant in the near wellbore rock. The second gas generator then acts as a pump for the injection of the gelant into the receptive formation.

For treatment of a specific fracture, the chemical gelant or cement slurry injection is limited to the specific narrow fracture interval to avoid contaminating the adjacent matrix. The treatment procedures are modified because formation treatment may not be needed and may be counterproductive. Therefore, this type treatment of a conductive water-bearing fracture has only one phase where gas generators are used for the injection of the gelant or cement slurry directly into the fracture. The treatment chemical or slurry is injected into the fracture with a low horsepower gas generator. An adequate volume of treatment liquid must be produced into the wellbore within the treatment interval to fill the fracture.

Another application of a low horsepower gas generator of this invention lies in the strengthening of a formation adjacent a parent well bore in order to drill lateral drain holes. The lateral drain holes intersect the parent, usually vertical well bore, and weaken the formation adjacent the intersections. It has become the practice to drill lateral drain holes by milling windows in a cased parent well bore. It is imperative that the casing be in good condition and the formation be competent. This presents a problem in formations of high porosity and high permeability.

To insure adequate structural strength of the formation at the junction of the drain holes and parent well bore, a window is milled in the casing of the parent well bore and a short lateral, e.g. 15–20' is drilled into the formation. A gas generator is conveyed on tubing into the short lateral and the well bore is filled, or substantially filled, with a compatible liquid. The gas generator is ignited to create multiple fractures in the high permeability formation adjacent to and around the parent well bore. A high strength cement slurry or high strength polymer is injected into the multiple fracture network around the short lateral and around the parent well bore to consolidate the formation at the junction and insure a good cement bond around the parent casing. The cement or polymer is allowed to set and the lateral drain hole or holes are drilled to their designed targets.

EXAMPLE 1

This oil well is in a sandstone formation with core permeability from 40–200 millidarcies. Although the variation in core permeability is not great, cement invasion creates a much larger permeability contrast. Total measured depth is 5450'. 7"29#/foot casing was cemented at 5300'. Plug back total depth is 2532'. 2⅞" production tubing is set at 2266' with a packer at 2210'. The annulus between the casing and tubing, above the packer, is filled with 8.6 #/gal brine to which a corrosion inhibitor was added.

The interval 2327-63' was perforated with 4 shots per foot at 90° phasing in an attempt to convert the well to a water injection/disposal well. The result was unsatisfactory and a spinner survey shows that a 2' zone is taking 95% of the water, showing that the actual permeability of the perforations has a much wider contrast than suggested by core sample permeabilities. Attempts to modify the injection profile by chemical hydraulic treatments with foam diverters failed.

A gas generator treatment is designed to cover the perforated interval. The 2⅞" tubing and packer limit the options to a 1.625" diameter 36' long gas generator, housed in a 2⅙" OD perforated steel carrier. It will be noted that the length of the gas generator is the same as the length of the perforated interval. In the 7" casing, this gas generator provides a loading density of 6.25%. A compatible well fluid is pumped into the well and fills the casing and tubing well above the 2327-63' interval. The gas generator is lowered into the well on electric conductor cable so the 36' long gas generator is immediately opposite the 36' long perforated interval. On ignition, the surface instruments indicate a momentary weight loss of 500 pounds on the cable. Experience suggests this means successful combustion of the propellant charge. The expendable carrier is pulled out of the hole. Another spinner survey is run indicating that all perforations have been opened and are equally conductive. The zone 2327-63' is now considered conditioned to respond to the chemical treatment. An acid is bullheaded into the perforations resulting in uniform injectivity over the thirty six foot long perforated interval providing higher injection rates and lower injection pressures.

EXAMPLE 2

This directionally drilled well is completed in a sandstone formation. A 7" liner is set at 12,023' MD. The well has a maximum deviation of 78°. The perforated zones are 11,070-082' and 11,002-14'. The purpose of the treatment is to reduce water production and increase the oil-water ratio. The conformance treatment phase is done with 2.5"×12' gas generators (loading density 16.6%) housed in 3" OD perforated steel carriers and are conveyed into the well on coiled tubing. The purpose of the conformance treatment is to open all perforations in each zone and make the formation receive a polymer liquid more-or-less equally through all of the perforations. The gas generator is ignited by pumping a ball down the tubing to activate a pressure igniter.

For the chemical injection phase, a 2"×12' gas generator in a 2.5" perforated steel carrier is used, giving a loading density of 10.6%. The smaller gas generator allows more room for the chemical in the wellbore adjacent the perforations to be treated. The 2" gas generator is conveyed by coiled tubing to the lower set of perforations. The polymer, which acts to change the relative permeability of the formation with respect to oil and water, is pumped down the tubing and distributed over the 12 foot zone. Immediately following the chemical, a ball is pumped down the tubing to set off the igniter, thereby initiating combustion of the propellant charge and releasing a large volume of high pressure gas driving the treatment liquid into the formation. The process is repeated for the second zone. The lower zone may be isolated mechanically, i.e. by a removable bridge plug, or a heavier liquid, such as brine, may be spotted below the targeted treatment zone to provide a temporary barrier and prevent downward migration of the polymer.

EXAMPLE 3

Eliminating Need for Mechanical Zone Isolation

This directionally drilled well penetrates a thick sandstone reservoir having multiple producing zones with marked permeability contrast. The conventional treatment for wells in this reservoir is to isolate each zone mechanically and then treat the zones individually.

Mechanical isolation of a zone requires pulling the production tubing and setting a bridge plug below the zone by wireline. An isolation packer is then run into the well on a tubing workstring. The packer is set above the perforated zone to be treated. Any liquid pumped down the tubing is now confined to the isolated zone. In deep wells, the procedure can take several days of down time per zone. The application of gas generators was suggested as a solution to eliminate mechanically isolating a zone to be treated.

The well to be treated has a 4½" OD liner, 0.25" wall, set at 11,150' and extending to TD. The well was perforated at 11,196-201' with twenty jet charges. An injectivity test was performed on this zone at a constant rate of 0.5 barrels per minute. The pressure was 315 psi.

A 2 inch OD×6' long gas generator was conveyed on wireline to the zone 11,196-201' and ignited under a full column of 3% potassium chloride/water solution, resulting in a hydrostatic bottom hole pressure of 4500 psi. The 2" gas generator provided a loading density of 25% because the 4½" OD liner has a 4" ID. The peak pressure generated was recorded by ballistic gauge at 9300 psi. This pressure was in close agreement with predictions of the chart in FIG. 2.

A second injectivity test was performed in the same zone at the constant rate of 0.5 barrels/minute. The pressure was 70 psi. This represents a 550% improvement in infectivity.

A second interval, 125' above the lower zone, was then perforated with twenty jet charges at 11076-081'. An identical 2" OD gas generator was ignited opposite the upper zone and a peak gas pressure of 10,300 psi was recorded. This pressure value was well within the predictions of FIG. 2 and within the safe pressure limits for the 4½" liner, the cement bond and all other completion components. The injectivity test was not repeated for the upper zone because the first series of tests provided convincingly proof of the control and effectiveness of the gas generator application. Since the permeability contrast between the upper and lower zones had been essentially eliminated, both zones were conventionally fraced simultaneously by bullheading gelled water and proppant into the perforations. The treatment was judged successful both technically and economically.

EXAMPLE 4

Long Zone

This well penetrates a thick shaley sandstone reservoir with large permeability contrasts. A recent spinner survey indicated that a large part of the perforated zone from 4180-4440' was not contributing any production. Several hydrochloric acid treatments by bullheading failed to improve the inflow from the perforated zone. The application of gas generators was suggested as a solution.

This well has a 5" OD liner, perforated at four shots/foot at 4180-4440'. Gas generators of 1.625" OD and 24 feet long, providing a loading density of 13%, were conveyed on conductor cable through the 2⅞" production tubing to the perforated zone. Because of the length of the perforated interval, the clean out treatment was done in ten successive stages. In each stage, a tool was run into the well, set at successively higher positions and then ignited. The well was partially filled with salt water having a scale inhibitor therein. The bottom hole hydrostatic pressure was about 1000 psi at the perforations. The peak pressure generated by the gas generated was recorded with a ballistic gauge on each run and averaged 3490 psi. These pressure results were well within the range predicted by FIG. 2.

The conditioning treatment with gas generators was followed by chemical treatments in which hydrochloric acid was bullheaded into the well. Total well production before the treatment was 60 barrels of oil per day. This increased to 461 barrels of oil per day after the treatment.

One of the important advantages of this invention is that the controlled low horsepower delivered by the gas generator 28 protects downhole completion equipment such as packers, bridge plugs and the like from the effects of shock loading.

Most wells completed in recent times involve drilling through the productive formation, cementing a casing string in the well bore and then perforating the productive interval with shaped charges or bullets. This is in contrast to earlier times when most wells were completed by drilling a foot or so into the productive zone, cementing casing to the bottom of the hole and then drilling into the productive formation so it was completed in the open hole, i.e. most of the productive interval was uncased. Open hole completions usually exhibit less permeability contrasts than cased hole completions because there is little effect of cement invasion into the formation. Even so, there are many situations where open hole completions need to be treated with liquids and substantial permeability contrasts exist. Thus, it is within the scope of this invention to treat an open hole completion with the gas generator of this invention to reduce permeability contrasts prior to treating the formation with a treatment liquid.

It will accordingly be seen that the low controlled horsepower of this invention may be accomplished in a variety of ways but a preferred technique is to employ a loading density of less than 25% in a cased hole and to use an average linear ignition velocity of 100–2000 feet/second and preferably a linear ignition velocity in the range of 100–1000 feet/second.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of treating a well having a production string penetrating a subterranean formation and communicating therewith through a multiplicity of perforations exhibiting high permeability contrasts prior to treating the well, comprising placing a first liquid, compatible with the formation, in the production string and igniting a gas generating propellant charge in the production string under conditions that create sub-critical flow in the perforations and thereby clean out the perforations without creating long channels extending away from the well into the formation; and after the gas generating charge has completed burning and while the perforations are cleaned out, placing a second liquid in the production string and then pumping the second liquid into the formation, the second liquid being effective to treat the formation.

2. The method of claim 1 wherein the conditions include igniting the propellant charge with a linear ignition velocity of less than 2000 feet per second and wherein the cross-sectional area of the propellant charge is not greater than about 25% of the cross-sectional area of the inside of the production string.

3. The method of claim 2 wherein the gas generator exhibits a linear ignition velocity of 100–2000 feet per second.

4. A method of treating a well having a production string penetrating a subterranean formation and communicating therewith through a multiplicity of perforations exhibiting high permeability contrasts, comprising placing a first liquid, compatible with the formation, in the production string and igniting a gas generating propellant charge in the production string under conditions that create sub-critical flow in the perforations and thereby clean out the perforations without creating long channels extending away from the well into the formation; and while the perforations are cleaned out, placing a second liquid in the production string and then pumping the second liquid into the formation, wherein the pumping step comprises igniting a second gas generating propellant charge in the production string under conditions that force the second liquid through substantially all of the open perforations and do not fracture the formation, the second liquid being effective to treat the formation.

5. The method of claim 4 wherein the step of igniting the second gas generating propellant charge is done before placing the well back on production.

6. The method of claim 4 wherein the first liquid is salt water.

7. The method of claim 4 wherein the first liquid is a liquid produced from the formation.

8. The method of claim 4 wherein the well penetrates at least two hydrocarbon productive formations and the perforations communicate between the production string and the two hydrocarbon productive formations, and wherein igniting the first mentioned gas generating propellant charge cleans out all the perforations without fracturing either of the formations; and wherein igniting the second gas generating propellant charge forces the second liquid through substantially all of the open perforations into the two hydrocarbon formations and does not fracture either of the formations, the second liquid being effective to treat the formations.

9. The method of claim 8 wherein the first gas generating propellant charge produces a first predetermined horsepower and the second gas generating propellant charge produces a second predetermined horsepower substantially identical to the first predetermined horsepower.

10. The method of claim 1 further comprising the step of testing the formation to determine whether the perforations exhibit high permeability contrasts before igniting the gas generating propellant charge.

11. The method of claim 10 wherein the testing step comprises conducting a spinner test adjacent different ones of the perforations.

12. The method of claim 11 wherein the spinner test comprises running a spinner tool into the well and sequentially positioning the spinner at different vertical positions in the well, pumping a liquid down the production string and determining if different ones of the perforations conduct the pumped liquid differently.

13. The method of claim 10 wherein the testing step comprises conducting an injectivity test on the formation.

14. The method of claim 10 wherein the testing step comprises bullheading a treatment liquid into the formation and determining the success of the treatment liquid.

15. The method of claim 1 wherein, prior to the step of placing the first liquid, bullheading a third liquid through the perforations into the formation in an attempt to improve productivity of the formation and determining that productivity was not improved.

16. The method of claim 1 wherein the well penetrates at least two hydrocarbon productive formations and the perforations communicate between the production string and the two hydrocarbon productive formations, and wherein the first mentioned gas generating propellant charge is positioned adjacent a first of the formations and cleans out all the perforations communicating with the first formation without fracturing either of the formations; and further comprising igniting a second gas generating propellant charge adjacent a second of the formations thereby cleaning out all the perforations communicating with the second formation without fracturing either of the formations, the first and second propellant charges being ignited sequentially, the first and second formations being in communication inside the production string during combustion of each of the first and second propellant charges.

17. The method of claim 1 wherein the perforated interval is of a predetermined length having a first end and a second end and the gas generator includes a propellant charge of the same length having a top and a bottom and wherein the gas generator is positioned so the top is opposite the first end of the perforated interval and the bottom is opposite the second end of the perforated interval.

18. A method of treating a well having a production string cemented in a well bore wherein the well bore extends substantially into a subterranean formation and the production string does not, the subterranean formation exhibiting high permeability contrasts, comprising placing a first liquid, compatible with the formation, in the production string and igniting a first gas generating propellant charge in the production string under circumstances that create sub-critical flow adjacent the formation in the well bore below the production string and thereby clean out the formation without creating long channels extending away from the well into the formation; and while the formation is cleaned out, placing a second liquid in the production string and then pumping the second liquid into the formation.

19. The method of claim 18 wherein the pumping step comprises igniting a second gas generating propellant charge in the production string under circumstances that force the second liquid through substantially all of the subterranean formation and do not fracture the formation, the second liquid being effective to treat the formation.

20. The method of claim 1 wherein the first liquid is unreactive with the formation.

21. The method of claim 1 wherein, prior to the step of placing the first liquid, bullheading a third liquid through the perforations into the formation in an attempt to improve injectivity of the formation and determining that injectivity was not improved.

* * * * *